US008066368B2

(12) United States Patent
Maekawa et al.

(10) Patent No.: US 8,066,368 B2
(45) Date of Patent: Nov. 29, 2011

(54) INKJET PRINTER HAVING A SUCTION UNIT MOUNTED ON A COVER OF THE PRINTER

(75) Inventors: Hironori Maekawa, Suwa (JP); Shun Oya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 496 days.

(21) Appl. No.: 12/290,065

(22) Filed: Oct. 27, 2008

(65) Prior Publication Data

US 2009/0147065 A1 Jun. 11, 2009

(30) Foreign Application Priority Data

Oct. 25, 2007 (JP) ..... 2007-277264

(51) Int. Cl.
*B41J 29/13* (2006.01)

(52) U.S. Cl. ..... 347/108; 347/104

(58) Field of Classification Search ..... 347/104, 347/108

See application file for complete search history.

(56) References Cited

U.S. PATENT DOCUMENTS

| | | | | |
|---|---|---|---|---|
| 6,543,948 | B2 * | 4/2003 | Beehler et al. | 400/635 |
| 6,629,796 | B2 | 10/2003 | Kawakami et al. | |
| 6,679,602 | B1 * | 1/2004 | Bruhn | 347/104 |
| 7,207,671 | B2 * | 4/2007 | Morris et al. | 347/108 |
| 7,309,179 | B2 * | 12/2007 | Toran et al. | 400/648 |
| 2005/0232679 | A1 * | 10/2005 | Na et al. | 400/649 |
| 2010/0220166 | A1 * | 9/2010 | Ishida et al. | 347/104 |

FOREIGN PATENT DOCUMENTS

| | | |
|---|---|---|
| JP | 62-215447 | 9/1987 |
| JP | 2000-055015 | 2/2000 |
| JP | 2002-264414 | 9/2002 |
| JP | 2006-248040 | 9/2006 |

* cited by examiner

*Primary Examiner* — Julian Huffman
*Assistant Examiner* — Sharon A Polk
(74) *Attorney, Agent, or Firm* — Nutter McClennen & Fish LLP; John J. Penny, Jr.; Christina M. Sperry

(57) ABSTRACT

The invention provides, as an aspect thereof, an inkjet printer that connects a vacuum fan on the printer case side and a vacuum platen on the cover side through a short vacuum path. The platen moves in conjunction with the cover of the roll paper compartment. The platen is a vacuum platen having vacuum regions, suction holes and a platen-side air path on the platen side, and a vacuum fan and a vacuum duct that connects the vacuum fan to the suction unit of the platen on the printer case side. The vacuum duct is disconnected from the suction unit of the platen when the platen moves in conjunction with the cover, and the length of the vacuum duct can therefore be short, corresponding to the distance between the intake opening of the vacuum fan and the suction unit of the platen when the cover is closed.

7 Claims, 6 Drawing Sheets

INKJET PRINTER HAVING A SUCTION UNIT MOUNTED ON A COVER OF THE PRINTER

BACKGROUND OF THE INVENTION

1. Field of Invention

The present invention relates to an inkjet printer having a vacuum platen that conveys a recording medium held by suction, and relates more particularly to an inkjet printer in which the recording medium transportation path is opened by opening the cover to which the vacuum platen is attached.

2. Description of Related Art

Inkjet printers that print on roll paper or other continuous recording medium and have a vacuum platen to prevent the printing paper transported over the platen from rising off the platen and interfering with the nozzle surface of the inkjet head are known from the literature. Japanese Unexamined Patent Appl. Pub. JP-A-2002-264414, for example, teaches a printer having a vacuum platen with numerous suction holes for pulling the recording medium to the platen surface.

When loading the roll paper in an inkjet printer that prints to roll paper, it is also necessary to set the recording medium delivered from the paper roll stored in the roll paper compartment between the inkjet head and platen, between the paper feed roller and pressure roller, and out from the paper exit. To simplify this paper loading task, Japanese Unexamined Patent Appl. Pub. JP-A-2006-248040 teaches a printer configured so that opening the cover to the roll paper compartment also opens the roll paper transportation path.

This inkjet printer configured so that opening the cover also opens the roll paper transportation path has the platen that opposes the inkjet head mounted on the cover side of the transportation path. When the vacuum platen is disposed to the cover, the suction opening of the vacuum fan on the stationary printer frame side must be connected by a vacuum duct to the vacuum platen, which is on the cover and thus moves.

The vacuum duct must therefore be flexible and long enough to adjust to the variable distance between the vacuum platen and the vacuum fan when the cover opens and closes, or the vacuum duct must be routed through the center of the opening and closing motion of the cover so that the duct is not affected by a change in length when the cover opens and closes. Because the length of the vacuum duct changes in both of these configurations, however, path resistance increases in the vacuum path through the vacuum duct and loss of suction therefore also increases. It is therefore necessary to use a relatively high capacity vacuum fan, and this interferes with reducing printer size and cost.

SUMMARY OF THE INVENTION

An inkjet printer according to the present invention enables connecting a vacuum fan on the printer frame side through a short vacuum path to a vacuum platen on a cover that opens and closes.

A first aspect of the invention is an inkjet printer having a cover that is disposed to open and close to the printer case; a vacuum platen that has a suction unit mounted on the cover for pulling printing medium to the platen; a vacuum fan disposed to the printer case; and a vacuum path enabling connecting and disconnecting the intake opening of the vacuum fan to the suction unit of the vacuum platen.

When the vacuum platen moves in conjunction with opening the cover, the invention disconnects the vacuum path that connects the intake opening of the vacuum fan to the suction unit of the vacuum platen. When the vacuum platen then returns to its original position in conjunction with closing the cover, the vacuum path reconnects the intake opening of the vacuum fan and the suction unit of the vacuum platen. The vacuum path can therefore have a short length corresponding to the distance between the intake opening of the vacuum fan and the suction unit of the vacuum platen when the cover is closed. In addition, because a short vacuum path can be used, path loss of the air stream can be reduced and need for a large vacuum fan can be avoided.

Preferably, vacuum path includes a vacuum duct, and the vacuum duct disconnects from the intake opening when the cover opens.

When the cover opens, this aspect of the invention disconnects the intake opening of the fixed-position vacuum fan and the suction unit of the vacuum platen mounted on the moving cover. The vacuum duct can therefore have a short length corresponding to the distance between the intake opening of the vacuum fan and the suction unit of the vacuum platen when the cover is closed. Furthermore, because the vacuum path from the vacuum fan to the vacuum platen through the vacuum duct can be short, path loss of the air flow can be reduced and need for a large vacuum fan can be avoided.

If the printer according to another aspect of the invention has a medium storage compartment formed inside the printer case, the cover is a cover for opening and closing the medium storage compartment.

When the cover opens, the paper transportation path for feeding paper stored in the medium storage compartment opens and paper can be easily loaded in the transportation path.

In another aspect of the invention the vacuum duct can be connected to the intake opening of the vacuum fan. A platen-side open end that contacts a duct-end opening of the vacuum duct when the cover closes is preferably also formed in the suction unit of the vacuum platen.

If the platen opens and closes with the cover and the vacuum duct is disposed on the same side as the platen, space sufficient to prevent the vacuum duct from interfering with other parts when the cover opens and closes must be provided. However, by locating the vacuum duct at a fixed position on the printer case side as in the invention, an increase in the space needed to open and close the cover can be avoided, thus facilitating reducing the size of the printer.

Further preferably, the duct opening and the opening to the platen contact through an intervening seal member. An air-tight seal can therefore be made, air leakage can be avoided or reduced, and a good vacuum characteristic can be maintained in the platen.

If the cover is attached to open and close forward and back pivoting at the bottom end part at the front of the printer case, the platen-side open end is formed at a position on the side of the vacuum platen, the vacuum duct is disposed along the side of the printer case beside the medium storage compartment, and the vacuum fan is disposed at the back of the printer case.

In a serial inkjet printer with a serial inkjet head that travels bidirectionally through a printing area defined by the vacuum platen, space enabling the carriage on which the inkjet head is mounted must be provided beside the platen. This space also produces empty space behind this space for carriage movement. Therefore, by forming the platen-side opening at a position removed to the side from the printing area and rendering the vacuum duct connected thereto, this empty space inside the printer can be used efficiently.

An inkjet printer according to another aspect of the invention also has a vacuum mechanism for recovering ink mist produced from the inkjet head, and this vacuum mechanism is connected to the vacuum fan. Printer parts and space can thus be used more efficiently.

When the cover carrying the vacuum platen opens in an inkjet printer according to the invention, the vacuum path, such as the vacuum duct, connecting the suction unit of the vacuum platen and the intake opening of the vacuum fan is disconnected. The length of the vacuum duct can therefore correspond to the distance between the suction unit of the vacuum platen and the intake opening of the vacuum fan when the cover is closed. A drop in air flow due to path loss in the vacuum path can therefore be reduced, a relatively small capacity vacuum fan can be used, and increasing the size of the printer can be avoided.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of the present invention is described below with reference to the accompanying figures using a roll paper printer that uses roll paper as the recording medium as an example of a printer according to the invention.

General Configuration

Figure 1:
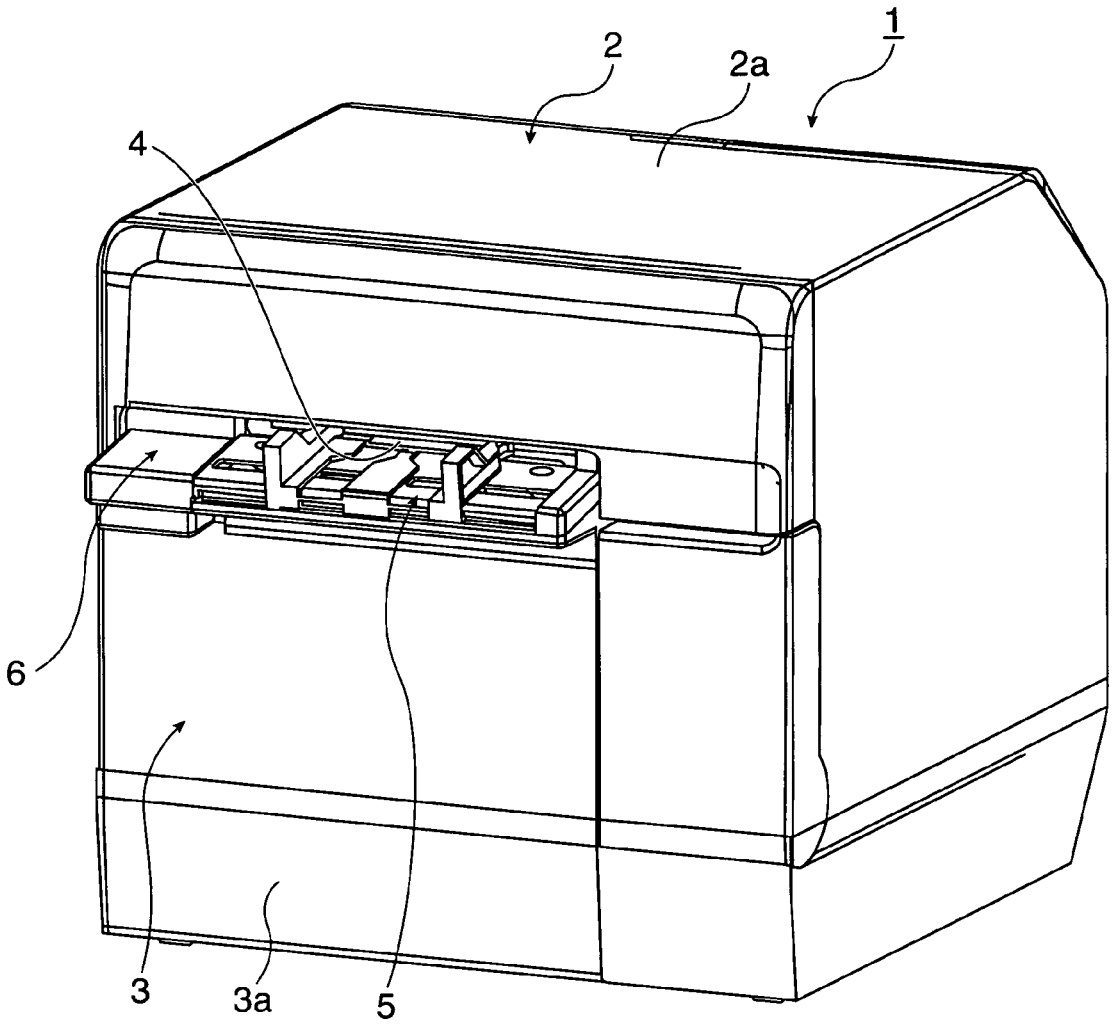
FIG. 1 is an external oblique view of a roll paper printer according to a preferred embodiment of the invention.
Figure 2:
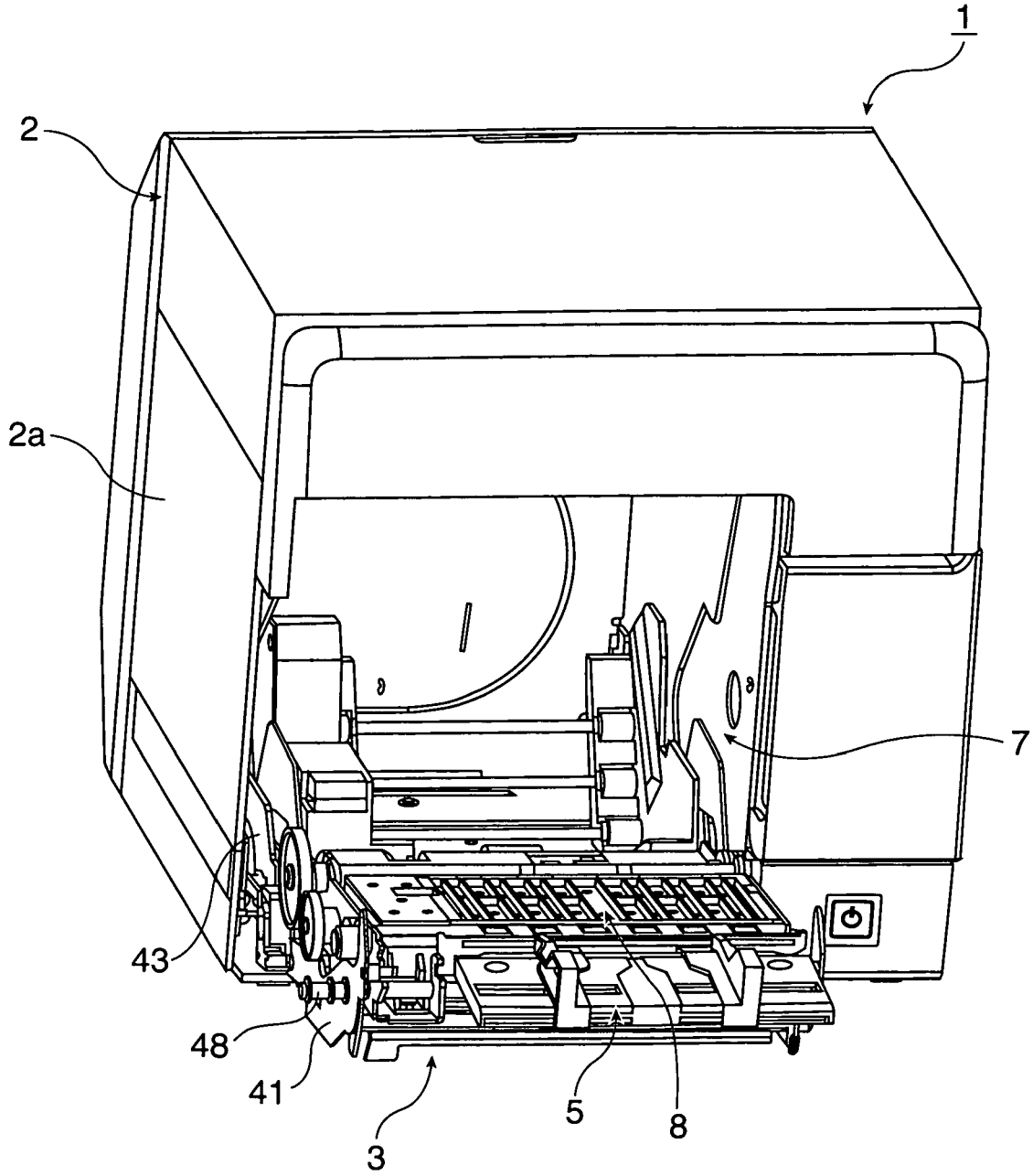
FIG. 2 is an external oblique view of the roll paper printer with the cover unit open.

FIG. 1 is an oblique view showing an inkjet roll paper printer according to a first embodiment of the invention. FIG. 2 is an oblique view of the same printer with the cover open.

The roll paper printer 1 has a rectangular box-like case 2 and a cover unit 3 that opens and closes and is disposed to the front of the case 2. The cover unit 3 includes a cover 3*a* and the opening/closing mechanism of the cover 3*a*. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening for loading and removing roll paper is formed in the outside case 2*a* below the exit guide 5 and cover opening lever 6, and this opening is closed by the cover 3*a*.

Operating the cover opening lever 6 unlocks the cover unit 3. When the exit guide 5 disposed to the cover unit 3 is pulled forward after the lock is released, the cover unit 3 pivots at the bottom end part thereof and opens forward to a substantially horizontal position as shown in FIG. 2. When the cover unit 3 opens, the roll paper compartment 7 formed inside the printer case 2 is open, the platen 8 that determines the printing position moves simultaneously with the cover unit 3, and the recording medium transportation path is open from the roll paper compartment 7 to the paper exit 4. As a result, the roll paper can be easily replaced from the front of the printer. Note that the cover 3*a* of the cover unit 3 and the cover opening lever 6 are not shown in FIG. 2.

Internal Configuration

Figure 3:
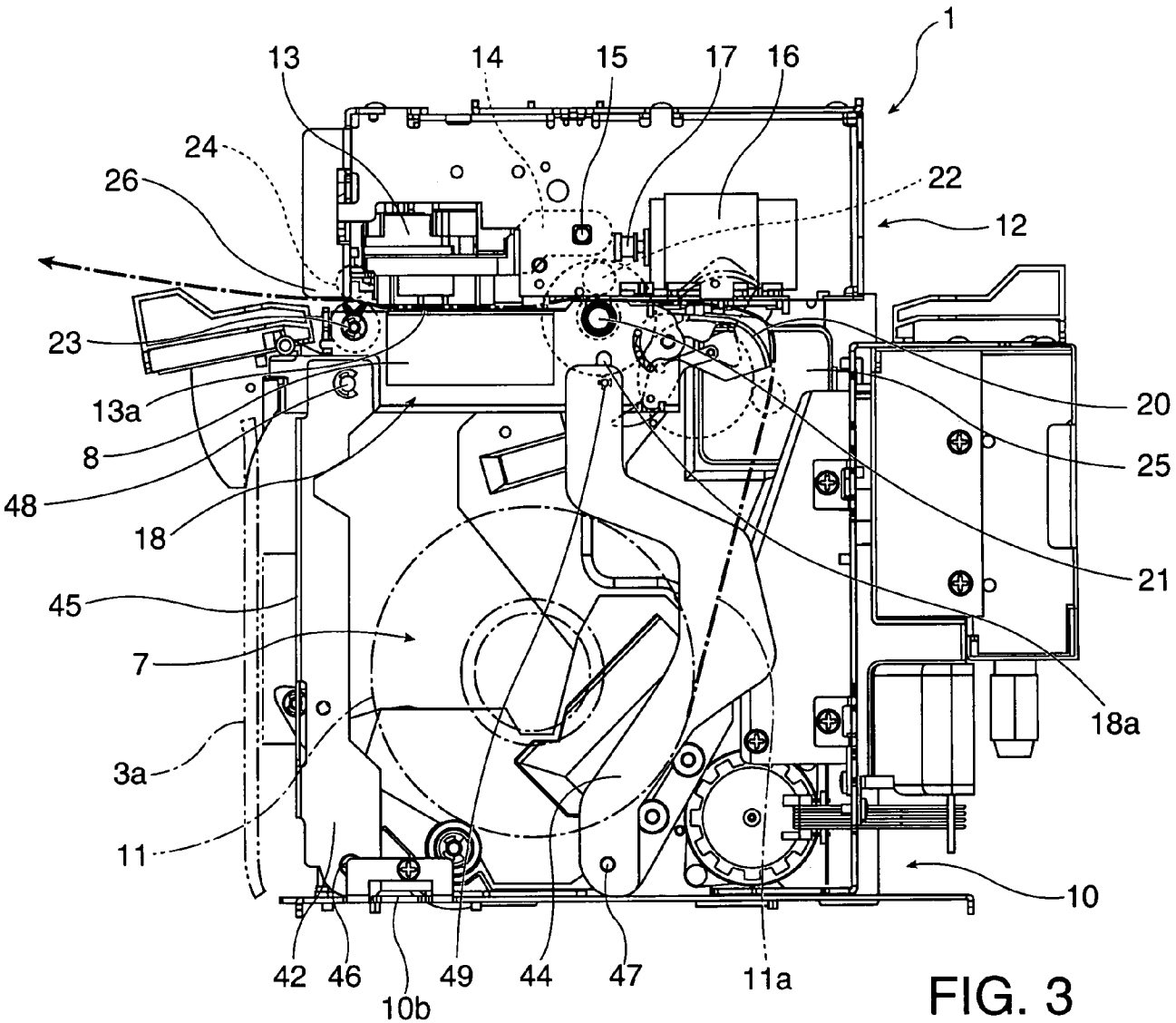
FIG. 3 is a vertical section view showing the internal structure of the roll paper printer.

FIG. 3 is a vertical section view showing the internal configuration of the roll paper printer, and shows the roll paper compartment 7 from the right side of the printer.

A roll paper compartment 7 is formed inside the roll paper printer 1 in the center between the sides of the printer frame 10. Roll paper 11 is stored inside the roll paper compartment 7 with the center axis of the roll disposed horizontally widthwise to the printer.

A head unit frame 12 is disposed horizontally at the top of the printer frame 10 above the roll paper compartment 7. Disposed to the head unit frame 12 are an inkjet head 13, a carriage 14 that carries the inkjet head 13, and a carriage guide shaft 15 that guides movement of the carriage 14 widthwise to the printer. The inkjet head 13 is mounted on the carriage 14 with the ink nozzle surface 13*a* facing down. The carriage guide shaft 15 extends horizontally widthwise to the printer, and a carriage drive mechanism including a carriage motor 16 and timing belt 17 for moving the carriage 14 bidirectionally along the carriage guide shaft 15 are also disposed to the head unit frame 12.

A platen frame 18 is disposed horizontally below the inkjet head 13 in the longitudinal direction of the printer (that is, the front to back direction). The platen 8 is disposed to the platen frame 18 horizontally in the lateral (widthwise) dimension. The platen 8 determines the printing position of the inkjet head 13 at a position opposite the inkjet head 13 with a predetermined gap therebetween.

A tension guide 20 that curves downward is attached at the back end of the platen frame 18. The tension guide 20 is urged upward by force of a spring, and the printing paper 11*a* pulled off the roll paper 11 stored in the roll paper compartment 7 travels through the recording medium transportation path passed the printing position with specific tension applied thereto by the tension guide 20.

A rear paper feed roller 21 is also disposed horizontally on the back side of the platen 8 widthwise to the printer. A rear paper pressure roller 22 of a predetermined width is pressed with predetermined force to the rear paper feed roller 21.

A front paper feed roller 23 is disposed to a position on the front side of the platen 8. A front paper pressure roller 24 is pressed to the front paper feed roller 23 from.

The rear paper feed roller 21 and front paper feed roller 23 are driven by a paper transportation motor 25 mounted on the printer frame 10.

The platen 8, tension guide 20, rear paper feed roller 21, and front paper feed roller 23 move with the cover 3*a* when the cover unit 3 opens and closes.

The platen 8 is a vacuum platen that can pull the printing paper 11*a* to the surface 8*a* of the platen 8. A recording medium vacuum mechanism for pulling the printing paper 11*a* to the surface 8*a* of the platen 8 is rendered to the platen 8 and printer case 2. This recording medium vacuum mechanism is described in detail below.

A part of the printing paper 11*a* delivered from the roll paper 11 is conveyed and passes the printing position while pulled to the surface 8*a* of the platen 8. The recording medium at the printing position is printed by the inkjet head 13 mounted on the carriage 14 as the carriage 14 travels back and forth along the carriage guide shaft 15.

After printing one line across the width of the printing paper 11*a* is finished, the rear paper feed roller 21 and front paper feed roller 23 are driven rotationally to advance the printing paper 11*a* a predetermined pitch. The next line is then printed. The printing paper 11*a* is thus printed by the inkjet head 13 while being intermittently advanced a predetermined pitch.

A scissors-like paper cutter 26 is disposed to the paper exit 4 from which the printing paper 11*a* is discharged after printing. The paper cutter 26 cuts across the width of the printing paper 11*a* disposed between the cutter knives.

Recording Medium Vacuum Mechanism

Figure 4:
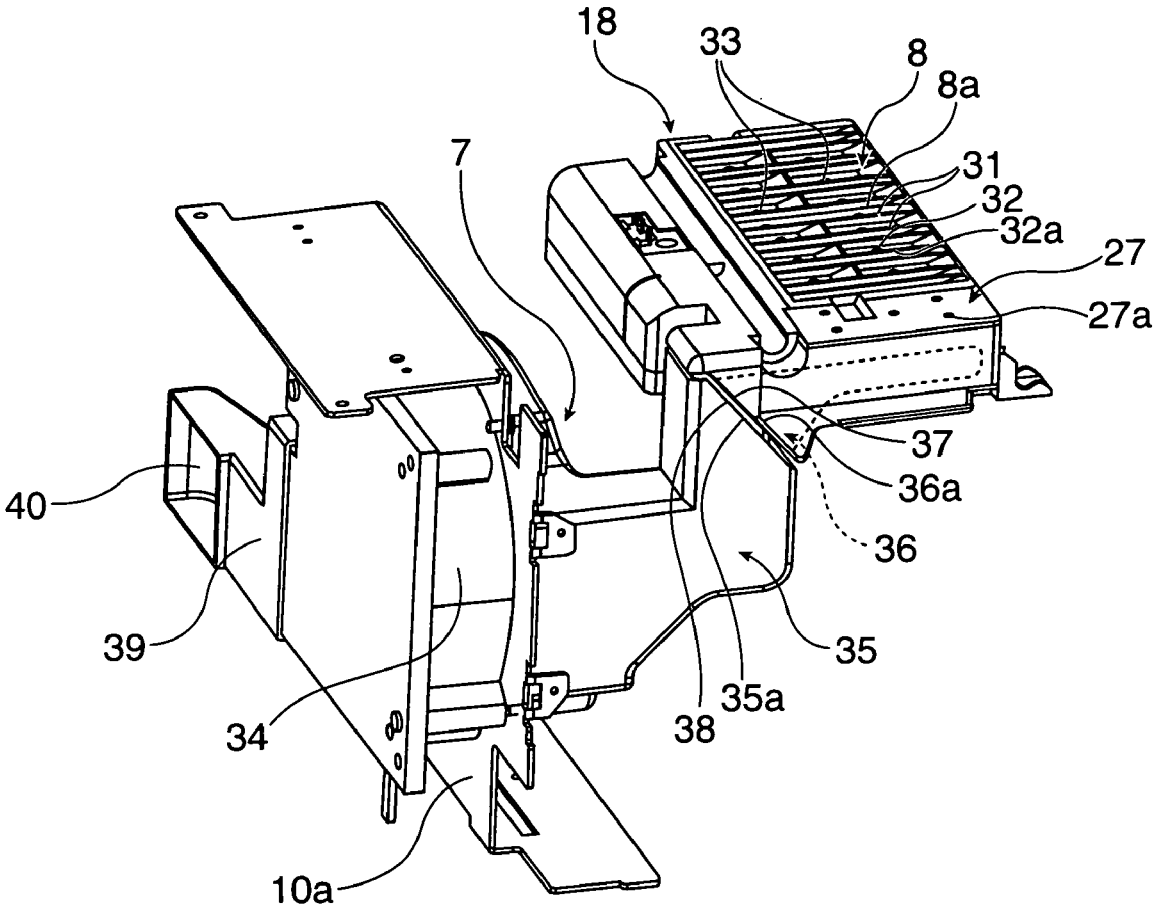
FIG. 4 is an oblique view showing the platen, air passage, and vacuum fan.
Figure 5:
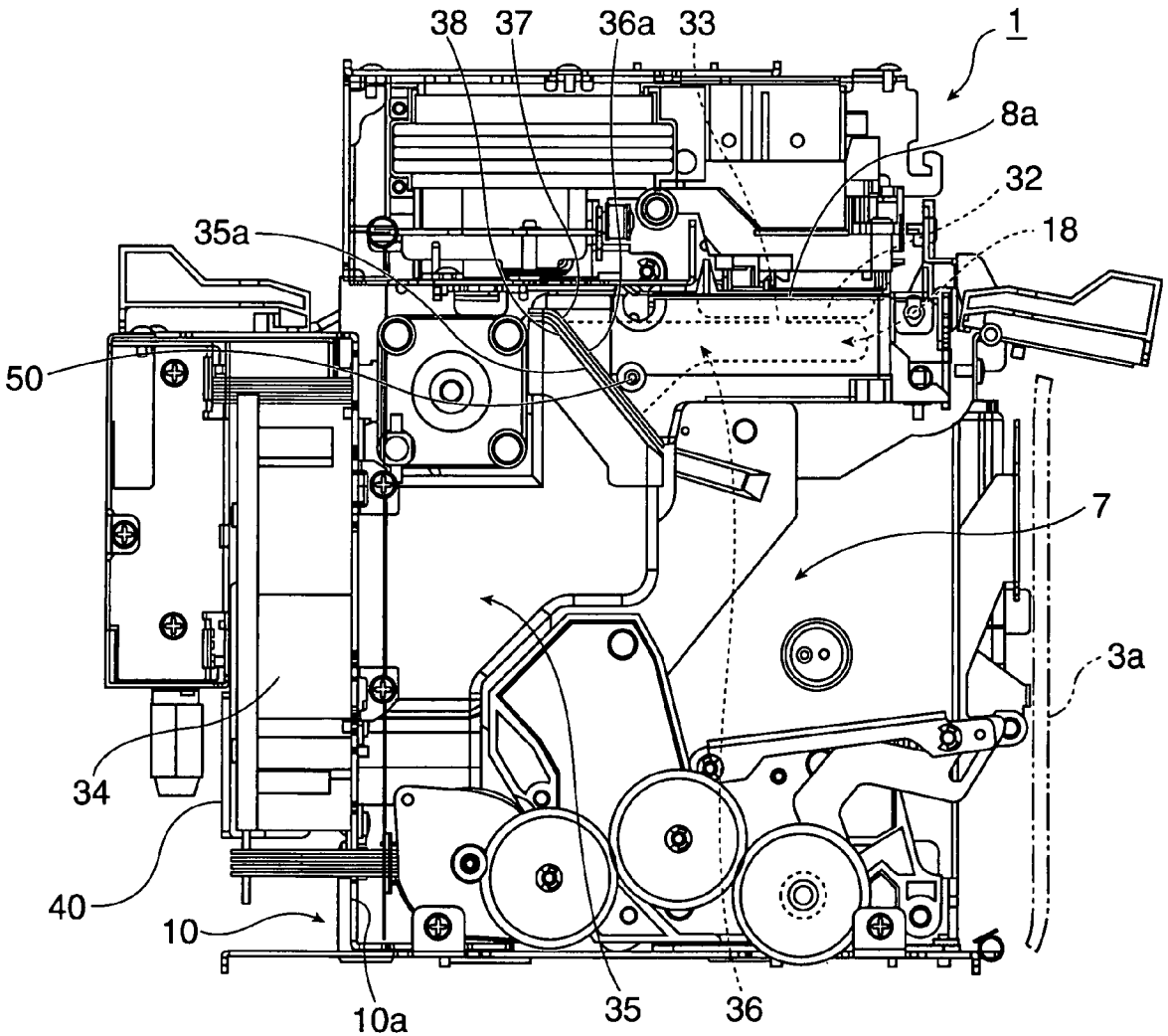
FIG. 5 is a vertical section view showing the air passage disposed on the roll paper compartment side.

The recording medium vacuum mechanism is described next with reference to FIG. 4 and FIG. 5. FIG. 4 is an oblique view of the platen 8 and the recording medium vacuum mechanism rendered in the printer case 2. FIG. 5 is a vertical section view of the side of the roll paper compartment 7 as seen from the left side of the printer. The cover unit 3 is closed in both figures, and the platen 8 determines the printing position.

The platen 8 is flat and rectangular with the long side oriented widthwise to the printer, and defines the printing area in the lateral dimension through which the inkjet head 13 travels back and forth. The recording medium vacuum mechanism includes a suction unit formed in the platen 8, a vacuum fan 34 disposed to the printer case 2, and a vacuum duct 35 that connects the intake opening of the vacuum fan 34 to the suction unit of the platen 8 and disconnects when the cover 3*a* opens. The suction unit includes a plurality of vacuum regions 32, a suction hole 33 formed in the bottom 32*a* of each vacuum region 32, and a platen-side air path 36 that communicates with each vacuum region 32 through the suction hole 33. The vacuum regions 32 are channels separated by a plurality of ribs 31 in the surface 8*a* of the platen 8. The vacuum path is thus formed from the vacuum fan 34 through the vacuum duct 35 to the suction unit formed in the platen 8.

An ink mist recovery unit 27 that recovers ink mist produced by the ink droplets discharged from the inkjet head 13 is formed beside the platen 8 in the platen frame 18 using the space provided to enable the carriage 14 carrying the inkjet head 13 to move. The platen-side open end 36*a* of the platen-side air path 36 is formed at a place behind and below the ink mist recovery unit 27, that is, at a position offset to the side from the printing area. The platen-side open end 36*a* slopes down and to the back side of the printer. A gasket 37 (seal) is attached to the platen-side open end 36*a*.

The vacuum fan 34 is attached to the back wall 10*a* of the printer frame 10. The vacuum duct 35 is disposed to the back wall 10*a* so that one end communicates with the intake opening of the vacuum fan 34. The other end of the vacuum duct 35 behind the ink mist recovery unit 27 is L-shaped, extending along the side of the printer case 2 beside the roll paper compartment 7 towards the front and then curving up. The duct opening 35*a* formed in the end part of the curved leg inclines upward toward the front, and a gasket 38 (seal) is attached to this end. The width of the vacuum duct 35 and the width of the ink mist recovery unit 27 are substantially equal. The vacuum duct 35 is rectangular in section.

A discharge path 39 that communicates with the discharge vent of the vacuum fan 34 is disposed at the bottom part of the back wall 10*a*. The discharge vent 40 of the discharge path 39 is open to the back of the printer case 2.

As shown in FIG. 4 and FIG. 5, the platen frame 18 is held substantially horizontal when the platen 8 is at the printing position, and an airtight seal is rendered between the platen-side open end 36*a* and duct opening 35*a* by the gaskets 37 and 38. An air path is thus rendered from the vacuum regions 32 in the surface 8*a* of the platen 8 through the vacuum fan 34 to the discharge vent 40. When the vacuum fan 34 is then driven, air is pulled in from the vacuum regions 32 and discharged from the discharge vent 40. This produces negative pressure inside each vacuum region 32, and the printing paper 11*a* is thus pulled to the surface 8*a* of the platen 8.

The ink mist recovery unit 27 has a mist vacuum hole 27*a* for vacuuming ink mist. This mist vacuum hole 27*a* communicates with the platen-side air path 36. A vacuum mechanism for recovering ink mist is thus rendered using the vacuum fan 34, vacuum duct 35, and platen-side air path 36 for pulling the printing paper 11*a* to the surface 8*a* of the platen 8.

Opening/Closing Mechanism for the Cover Unit

Figure 6:
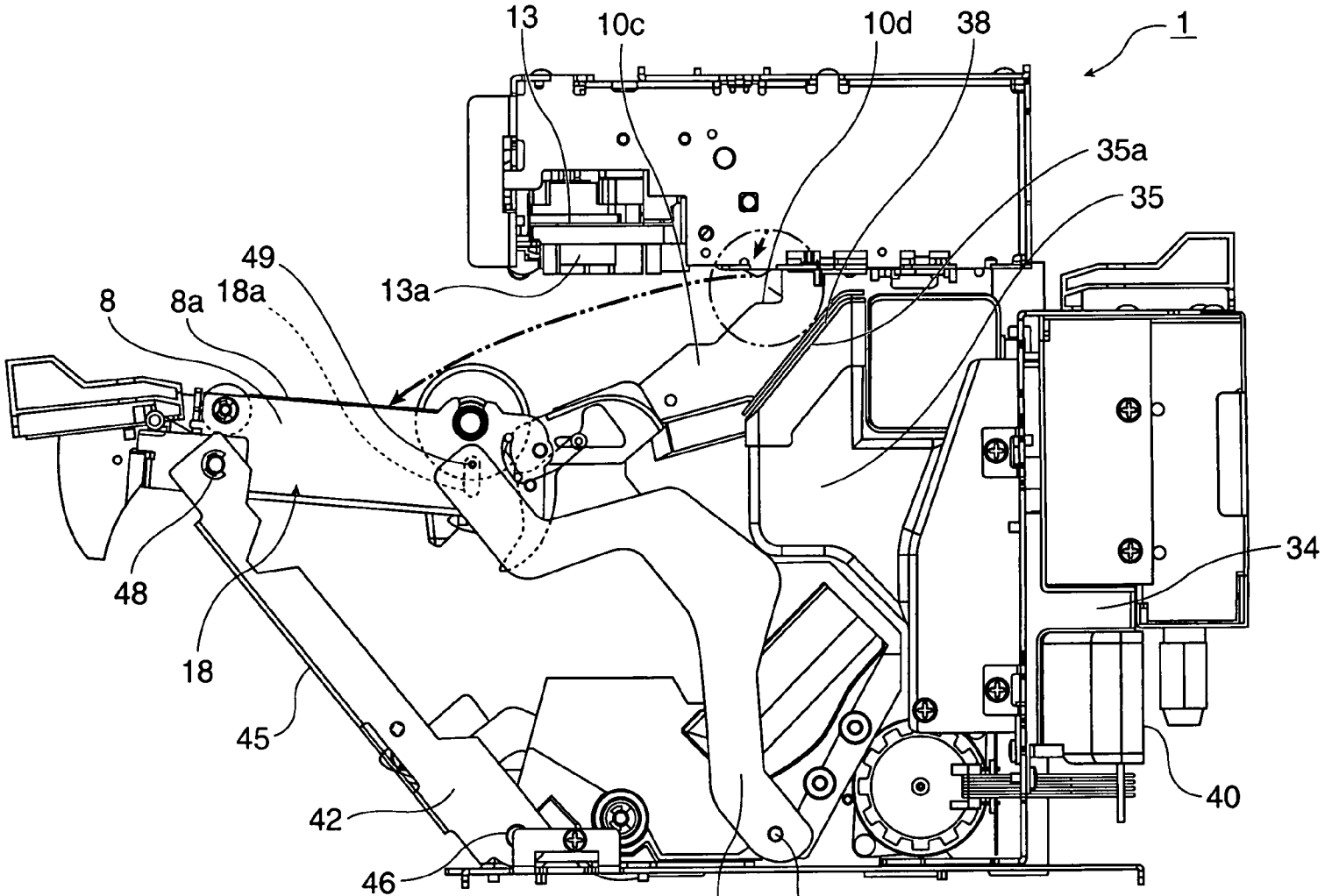
FIG. 6 is a side section view showing the cover unit slightly open.

The opening/closing mechanism for the cover unit 3 is described next with reference to FIG. 2, FIG. 3, and FIG. 6. FIG. 6 is a schematic side view showing the opening and closing mechanism for the cover unit, and shows the cover unit when pulled forward to open. Note that the cover 3*a* of the cover unit 3 is not shown in FIG. 6.

A head unit frame 12 is disposed horizontally at the top of the printer frame 10 above the roll paper compartment 7. Disposed to the head unit frame 12 are an inkjet head 13, a carriage 14 that carries the inkjet head 13, and a carriage guide shaft 15 that guides movement of the carriage 14 widthwise to the printer. The inkjet head 13 is mounted on the carriage 14 with the ink nozzle surface 13*a* facing down. The carriage guide shaft 15 extends horizontally widthwise to the printer, and a carriage drive mechanism including a carriage motor 16 and timing belt 17 for moving the carriage 14 bidirectionally along the carriage guide shaft 15 is also disposed to the head unit frame 12.

The top end parts of the front parallel links 41 and 42 are connected freely pivotably on a horizontal shaft 49 at the front end part of the platen frame 18. The top end parts of the rear parallel links 43 and 44, however, are connected so that a specific amount of vertical movement is possible between these top ends and the back end part of the platen frame 18. In this embodiment of the invention an elongated hole 18*b* with the long axis vertically oriented is formed in the platen frame 18, and a horizontal shaft 49 attached to the top end parts of the rear parallel links 43 and 44 is inserted pivotably and slidably in this hole 18*b*.

As shown in FIG. 6, an inclined positioning shoulder 10*d* that slopes upward from the front to the back is formed to a side part 10*c* of the printer frame 10 on the left side of the roll paper compartment 7. A positioning guide roller 50 (see FIG. 5) rides onto a position in the middle of the inclined positioning shoulder 10*d*. The guide roller 50 projects horizontally to the side from the left side of the platen frame 18, and is attached to rotate freely on the platen frame 18.

When the cover unit 3 is closed, the guide roller 50 rides onto the inclined positioning shoulder 10*c*, thus holding the platen frame 18 substantially horizontal and holding the platen 8 attached to the platen frame 18 in the printing position opposite the nozzle surface of the inkjet head 13 with a predetermined gap therebetween. The platen-side open end 36*a* of the platen-side air path 36 and the duct opening 35*a* of the vacuum duct 35 also touch, forming an airtight seal therebetween.

When the cover unit 3 opens and closes, the platen 8, the tension guide 20, the rear paper feed roller 21, the front paper feed roller 23, and other parts mounted on the platen frame 18 also open and close. The cover unit 3 drops forward pivoting on the horizontal shaft 46 of the front parallel links 41 and 42.

The complete platen frame 18 disposed between the front parallel links 41 and 42 and the rear parallel links 43 and 44 also moves forward and down. This movement causes the guide roller 50 of the platen frame 18 to drop along the inclined positioning shoulder 10*d*.

When the cover unit 3 opens, the paper transportation path from the roll paper compartment 7 to the paper exit 4 also opens. The platen-side air path 36 and the vacuum duct 35 also disconnect. If the cover unit 3 is opened further from the position shown in FIG. 6, the cover unit 3 can be opened to the substantially horizontal position shown in FIG. 2. In this open position the front parallel links 41 and 42 and rear parallel links 43 and 44 fold together to the platen frame 18 in a substantially horizontal position.

When the cover unit 3 is in the open position and is then closed, the action described above is reversed. More specifically, the guide roller 50 of the platen frame 18 rides onto the inclined positioning shoulder 10*d* formed on the side part 10*c* of the printer frame 10 slightly before the cover unit 3 closes, the guide roller 50 engages inclined positioning shoulder 10*d*, and the platen frame 18 is positioned substantially horizontally. As a result, the platen 8 is set to the printing position opposing the inkjet head 13 with a predetermined gap therebetween as shown in FIG. 3, and the platen-side open end 36*a* of the platen-side air path 36 and the duct opening 35*a* of the vacuum duct 35 contact with an airtight seal therebetween.

Effect of the Invention

When the cover 3*a* is opened, the vacuum duct 35 connecting the intake opening of the vacuum fan 34 in a fixed position to the suction unit of the platen 8 disposed to the movable cover 3*a* is disconnected. The length of the vacuum duct 35 can therefore be short, corresponding to the distance between the intake opening of the vacuum fan 34 and the suction unit of the platen 8 when the cover 3*a* is closed. Furthermore, because the vacuum path from the vacuum fan 34 to the platen 8 through the vacuum duct 35 can be short, path loss of air flow is reduced and the need for a large vacuum fan 34 can be avoided.

Space sufficient to prevent the vacuum duct 35 from interfering with other parts when the cover 3*a* opens and closes must be provided if the vacuum duct 35 is disposed on the side of the opening and closing platen 8. However, by disposing the vacuum duct 35 at a fixed position on the printer case 2 side as in the invention, an increase in the space needed to open and close the cover can be avoided, thus facilitating reducing the size of the printer.

When the cover 3*a* opens in this embodiment of the invention, the transportation path of the printing paper 11*a* delivered from the roll paper 11 stored in the roll paper compartment 7 opens, and the printing paper 11*a* can be easily set in the transportation path.

Furthermore, because the duct opening 35*a* of the vacuum duct 35 contacts the platen-side open end 36*a* with an airtight seal rendered therebetween by the intervening gaskets 37, 38 or other seal member, air leakage can be avoided or reduced, and a good vacuum characteristic can be maintained in the platen 8.

In a printer with a serial inkjet head 13, space enabling the carriage 14 on which the inkjet head 13 is mounted must be provided beside the platen 8 that defines the printing position (that is, space enabling the carriage 14 to move outside the printing area), resulting in empty space behind this space for carriage 14 movement. In this embodiment of the invention the platen-side open end 36*a* is formed at a position removed to the side from the printing area of the inkjet head 13. The vacuum duct 35 is then disposed along the side of the printer case 2 at a position behind this space reserved above the platen-side open end 36*a* that meets the vacuum duct 35. As a result, the vacuum duct 35 uses this empty space efficiently.

A vacuum mechanism including a ink mist recovery unit 27 for recovering ink mist produced from the inkjet head 13 is also rendered. This vacuum mechanism is connected to the vacuum fan using the platen-side air path 36, vacuum duct 35, and vacuum fan 34. The vacuum parts can therefore be shared, and both parts and space can thus be used more efficiently.

Other Embodiments of the Invention

The vacuum duct 35 can be separated from the suction unit formed in the platen 8 with the embodiment of the invention described above. However, the construction enabling disconnecting the duct portion connected to the suction unit of the platen 8 and the duct portion connected to the intake opening of the vacuum fan 34 can be rendered in the middle of the vacuum duct 35.

Further alternatively, the platen 8 may be rendered using a vacuum platen having the suction holes 33 rendered directly in the surface 8*a* of the platen 8.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An inkjet printer comprising:

a cover that is disposed to open and close to a printer case;

a vacuum platen that has a suction unit mounted on the cover for pulling a printing medium to the vacuum platen;

a vacuum fan disposed to the printer case;

a vacuum path enabling connecting and disconnecting an intake opening of the vacuum fan to the suction unit of the vacuum platen; and a medium storage compartment formed inside the printer case, wherein:

the cover is attached to pivot at a bottom end part at a front of the printer case in a back direction toward a back of the printer case to close, and is attached to pivot at the bottom end part in a forward, opposite direction to open;

a platen-side open end in the suction unit of the vacuum platen is formed at a position on a side of the vacuum platen;

the vacuum path is disposed along a side of the printer case beside the medium storage compartment;

the vacuum fan is disposed at the back of the printer case; and the cover is a cover for opening and closing the medium storage compartment.

2. The inkjet printer described in claim 1, wherein:

the vacuum path includes a vacuum duct; and the vacuum duct disconnects from the intake opening when the cover opens.

3. The inkjet printer described in claim 2, wherein:

the platen-side open end contacts a duct-end opening of the vacuum duct when the cover closes.

4. The inkjet printer described in claim 3, wherein:

the duct-end opening and the platen-side open end contact through an intervening seal member.

5. The inkjet printer described in claim 1, further comprising:

a serial inkjet head that moves bidirectionally through a printing area defined by the vacuum platen;

wherein the platen-side open end in the suction unit of the vacuum platen is formed at a position offset to a side of the printing area.

6. The inkjet printer described in claim 5, wherein:

the position offset to the side of the printing area is an empty space produced in conjunction with a space enabling a carriage carrying the inkjet head to move outside the printing area.

7. The inkjet printer described in claim 5, further comprising:

a vacuum mechanism for recovering ink mist produced from the inkjet head;

wherein the vacuum mechanism is connected to the vacuum fan.

* * * * *